US005608443A

United States Patent [19]

Palmer et al.

[11] Patent Number: 5,608,443

[45] Date of Patent: Mar. 4, 1997

[54] DRIVE SYSTEM FOR A THERMAL LABEL PRINTER

[75] Inventors: Matthew R. Palmer, Cambridgeshire; Ian Thompson-Bell, Hertfordshire, both of United Kingdom

[73] Assignee: Esselte N.V., St. Niklaas, Belgium

[21] Appl. No.: 333,392

[22] Filed: Nov. 2, 1994

[30] Foreign Application Priority Data

Nov. 5, 1993 [GB] United Kingdom ..... 9322984

[51] Int. Cl.[6] ..... B41J 11/00; B41J 2/32

[52] U.S. Cl. ..... 347/218

[58] Field of Search ..... 347/215, 218, 347/180, 4, 211; 400/238, 239, 249; 156/384; 242/413.9

[56] References Cited

U.S. PATENT DOCUMENTS

| | | | |
|---|---|---|---|
| 3,174,610 | 3/1965 | Barbagallo et al. | 197/133 |
| 3,931,761 | 1/1976 | Carrus et al. | 101/66 |
| 4,097,726 | 6/1978 | Satoh et al. | 242/357 |
| 4,313,683 | 2/1982 | Brown et al. | 400/225 |
| 4,532,525 | 7/1985 | Takahashi | 347/176 |
| 4,597,022 | 6/1986 | Kusunose | 360/62 |
| 4,623,902 | 11/1986 | Yamanishi | 347/217 |
| 4,680,078 | 7/1987 | Vanderpool et al. | 156/384 |
| 4,698,567 | 10/1987 | Gottwald et al. | 318/480 |
| 4,836,697 | 6/1989 | Plotnick et al. | 400/120 |
| 5,028,934 | 7/1991 | Kasai et al. | 347/215 |

FOREIGN PATENT DOCUMENTS

| | | |
|---|---|---|
| 0228291 | 8/1987 | European Pat. Off. . |
| 0350050 | 1/1990 | European Pat. Off. . |
| 0487312A1 | 5/1992 | European Pat. Off. . |
| 0573187A1 | 5/1993 | European Pat. Off. . |
| 61-057366 | 3/1986 | Japan . |
| 62-211148 | 9/1987 | Japan . |
| 5-122966 | 5/1993 | Japan . |
| 1566281 | 4/1980 | United Kingdom . |
| 2157039 | 10/1985 | United Kingdom . |
| 2187318 | 9/1987 | United Kingdom . |
| 2227460 | 8/1990 | United Kingdom . |
| 2251216 | 7/1992 | United Kingdom . |
| 2251217 | 7/1992 | United Kingdom . |

OTHER PUBLICATIONS

Patent Abstracts of Japan, vol. 13, No. 36 (M-790) 26 Jan. 1989 & JP-A-63 246251 (Toklyo Electric Co. Ltd.) 13 Oct. 1988.

Research Disclosure, No. 302, Jun. 1989 Havant GB, p. 424 XP 000034753 Anonymous 'Soft Sensing End of Ribbon'.

Research Disclosure, No. 286, Feb. 1988 Havant GB, p. 78 Anonymous 'Method of Detecting Ribbon Failue in a Printer'.

Patent Abstracts of Japan, vol. 10 No. 109 (M-472) [2166], 23 Apr. 1986 & JP-A-60 240487 (Matsushita Denki Sangyo K.K.) 20 Nov. 1985.

*Primary Examiner*—Benjamin R. Fuller
*Assistant Examiner*—L. Anderson
*Attorney, Agent, or Firm*—Pennie & Edmonds

[57] ABSTRACT

A label printing apparatus receives a cassette holding printing tape on which an image is to be printed. The apparatus also has a printing mechanism which includes a thermal printhead having a group of printing elements to which pixel data defining the image to be printed is passed sequentially on a group-by-group basis. The groups are printed adjacent one another in the direction of movement of the printing tape. A drive system is provided for driving the printing tape through the printing mechanism end includes a dc motor which is provided with a shaft encoder for monitoring the speed of rotation of the motor. Sequential printing of the groups of pixel data is controlled in dependence on the monitors speed of rotation of the motor. There is also described a label printing apparatus which uses monitoring of the speed of rotation of the motor to detect an end of tape condition.

13 Claims, 3 Drawing Sheets

7
6
3
A
4
2
28
32
36
34
30
20
24
26
16
40
22
BUFFER
POWER SUPPLY
15
18
OSCILLATOR
MICROCONTROLLER
12

DRIVE SYSTEM FOR A THERMAL LABEL PRINTER

FIELD OF THE INVENTION

This invention relates to a drive system for a printing apparatus.

BACKGROUND OF THE INVENTION

This invention is particularly but not exclusively concerned with the type of printing apparatus which are known as label printers. These apparatus have a housing carrying a data input device in the form of a keyboard for inputting a message to be printed and containing a printing mechanism and a drive system. The housing also includes a cassette receiving bay for receiving a cassette which houses printing tape and ink ribbon. There are several different types of this kind of label printer. Some receive a single cassette which houses at least a printing tape and an ink ribbon, as described for example in our earlier European Application No. 91310664.7. In another system, the cassette receiving bay receives two separate cassettes, one housing an ink ribbon and the other housing a printing tape. Such a system is described for example in our earlier European Application No. 93303971.1. The contents of these earlier applications are incorporated herein by reference. In these and other known types of systems, the ink ribbon and printing tape are passed in overlap between a thermal printhead and a platen of the printing mechanism. For printing, the ink ribbon is pressed against the printing tape between the thermal printhead and the platen and pixel data to be printed is passed to the thermal printhead. Normally, the thermal printhead comprises a column of printing elements to which data is supplied and printed sequentially. During printing, the printing tape is driven through the printing zone defined by the thermal printhead and platen so that adjacent columns are printed sequentially in the direction of movement of the printing tape, thereby forming characters etc to be printed.

As described in the above-referenced European Applications, the printing tape is a multilayer printing tape having an image receiving layer and a backing layer secured to the image receiving layer by an adhesive layer. The label printer includes a cutting mechanism for cutting off a portion of the multilayer tape after printing to form a label. The backing layer of the label can then be removed to allow the label to be stuck to any object.

FIG. 1 illustrates the elements of a drive system of a known printing apparatus. Reference numerals 2 and 4 denote the platen and thermal printhead respectively which constitute the main components of the print mechanism. Reference numerals 6 and 7 denote the tape 6 and ink ribbon 7 which are passed in overlap between the platen and thermal printhead for printing. Although not shown in FIG. 1, the ink ribbon lies adjacent the thermal printhead 4 and is wound from a supply reel to a take-up reel, normally within a cassette. In practice, the ink ribbon is driven past the printhead by the action of friction between the printing tape and the ink ribbon, the two being intended to run together at the same speed. The take-up reel is driven so that if free to do so it would pull the ink ribbon past the printhead faster than the platen would. A slipping clutch is normally provided to ensure that the ink ribbon moves at a speed defined by the platen motion, the clutch ensuring that ink ribbon slack is always taken up and tension maintained. The take-up reel can be driven with the platen to ensure that the ink ribbon is wound up, but other drive arrangements are possible. The platen is in any event driven to rotate and presses against the printing tape on one surface thereof, the other surface lying against the ink ribbon. The tape 6 is thus driven past the thermal printhead 4 by the action of friction between the tape 6 and the platen 2, which is normally made of rubber. The platen 2 is driven by a stepper motor 8 through a gear train which is illustrated only diagrammatically at reference numeral 10. The stepper motor 8 is in turn driven by signals from a microprocessor 12 via a driver chip 14. The stepper motor 8 completes a rotation in a number of discrete steps in response to a series of pulses sent from the microcontroller, normally one step per pulse. Reference numeral 15 denotes a power supply for the motor and microprocessor.

At the same time, data for printing is sent to the thermal printhead 4 from the microcontroller via the data line 16. The thermal printhead includes a shift register and a separate parallel storage register. Data is transferred to the printhead serially, clocked bit by bit under the control of the microcontroller into the shift register contained in the printhead assembly. At the end of the transfer of a column of pixel data, the data is latched into the storage register under command from the microcontroller. The storage register will hold this data until the next latching operation of new shift register contents into the storage register. Later, the printhead is "strobed" by the microcontroller to turn on high current output drivers in parallel which deposit melted ink from the ink ribbon onto the tape 6 in pixel patterns according to data held in the storage register. Clocking of data into the shift register can be occurring while a strobe signal causes printing of the data in the storage register, but it is not necessary that the operation occurs in this way, since the operations are essentially independent. As explained above, the thermal printhead has a column of printing element which are printed as a vertical line on the printing tape. A character is thus printed by printing a number of adjacent and slightly overlapping columns containing different pixel data on the printing tape as it moves past the thermal printhead.

The microcontroller 12 arranges for a certain number of step pulses to be sent to the stepper motor for each print column strobe signal, in a defined sequence in order to produce the correct relationship between tape motion and print data, thereby forming correctly proportioned characters. This process is continuous only in the sense that the motor rotates step-wise at roughly a constant speed during printing of a label. The motor does not continuously rotate.

The reference clock for the step pulses and for the print strobe signals is the same, derived for example from a crystal oscillator 18. The system relies on the assumption that, once the microcontroller has sent out the correct stepper motor drive and strobe signals in response to the reference clock, the motor and tape move as expected while ink is deposited on the printing tape at the thermal printhead. However, circumstances can arise where the tape can jam as a result of high friction levels at the platen, or elsewhere, such as in the gear trains. In that case, the motor will cease to step and adjacent columns of pixels will be printed overlapping one another, resulting in a useless label.

Moreover, a stepper motor is a relatively expensive component of label printers and has a relatively high power requirement. This is particularly disadvantageous where the label printer is to be operated on batteries.

SUMMARY OF THE INVENTION

According to the present invention in one aspect there is provided a label printing apparatus comprising: a housing carrying a data input device for inputting information defining an image to be printed and providing a cassette receiving bay for receiving a cassette holding printing tape on which the image is to be printed; a printing mechanism including a thermal printhead having a group of printing elements to which pixel data defining the image to be printed is passed sequentially on a group-by-group basis by a printhead controller, said groups to be printed adjacent one another in the direction of movement of the printing tape; and a drive system comprising: a dc motor operable to continuously drive said printing tape past the printing mechanism; and means for monitoring the speed of rotation of the motor and connected to said printhead controller to control the sequential printing of said groups of pixel data in dependence on the speed of rotation of the motor.

The dc motor preferably causes a platen to rotate which moves the printing tape through friction. The platen cooperates with the thermal printhead for printing image.

In the preferred embodiment, the speed monitoring means takes the form of a shaft encoder, for example comprising a slotted disc arranged to rotate with a shaft of the dc motor and a light source and a light detector on opposed sides of the disc. The printhead controller uses signals from the shaft encoder to control the sequential printing of the groups of pixel data to ensure that adjacent groups of pixel data are printed in the correct relationship which depends on the speed of the printing tape.

In another aspect there is provided a method of operating a label printing apparatus which comprises a housing carrying a data input device and providing a cassette receiving bay for receiving a cassette holding printing tape on which an image is to be printed, the method comprising: inputting information at the data input device defining the image to be printed; driving a dc motor to continuously rotate to drive the printing tape passed a printing mechanism which includes a thermal printhead having a group of printing elements to which pixel data defining the image to be printed is past sequentially on a group by group basis by a printhead controller; monitoring the speed of rotation of the motor; and controlling the sequential printing of groups of pixel data in dependence on the speed of rotation of the motor so that said group are printed adjacent one another in a direction of movement of the printing tape.

When the drive system is used in a printing apparatus which receives a tape cassette in which the printing tape is wound on a bobbin, the drive system can be used to provide an end-of-tape indication. If the end of the printing tape is secured to the bobbin so that it is prevented from moving, the stop can be detected by the speed monitoring means and an indication given accordingly of an end of tape state. The cassette can then be replaced by a fresh cassette. This principle can also be used to detect other fault conditions such as jamming or breaking of tape.

Thus, in another aspect of the invention there is provided a label printings apparatus comprising: a housing carrying a data input device for inputting information defining an image to be printed and providing a cassette receiving bay for receiving a cassette holding printing tape on which the image is to be printed; a drive system for a printing apparatus which has a printing mechanism including a thermal printhead and which is arranged to receive a printing tape wound on a supply reel, said printing tape having means at the end thereof to resist separation from the supply reel, the drive system comprising: a motor operable to drive said printing tape past the printing mechanism; and means for monitoring the speed of rotation of the motor thereby to detect a reduction in speed caused by said means at the end of the printing tape and thereby to indicate an end of tape state.

This aspect of the invention can be utilized where the motor is a stepper motor causing step-wise drive of the printing tape or where the motor is a dc motor causing continuous drive of the printing tape.

The means for resisting movement at the end of the tape can be implemented by securing the tape to the supply reel at its end. High friction material could additionally be provided at the end of the tape so that it slows down the platen and motor once the tape motion has stopped.

DESCRIPTION OF THE PREFERRED EMBODIMENT

Figure 2:
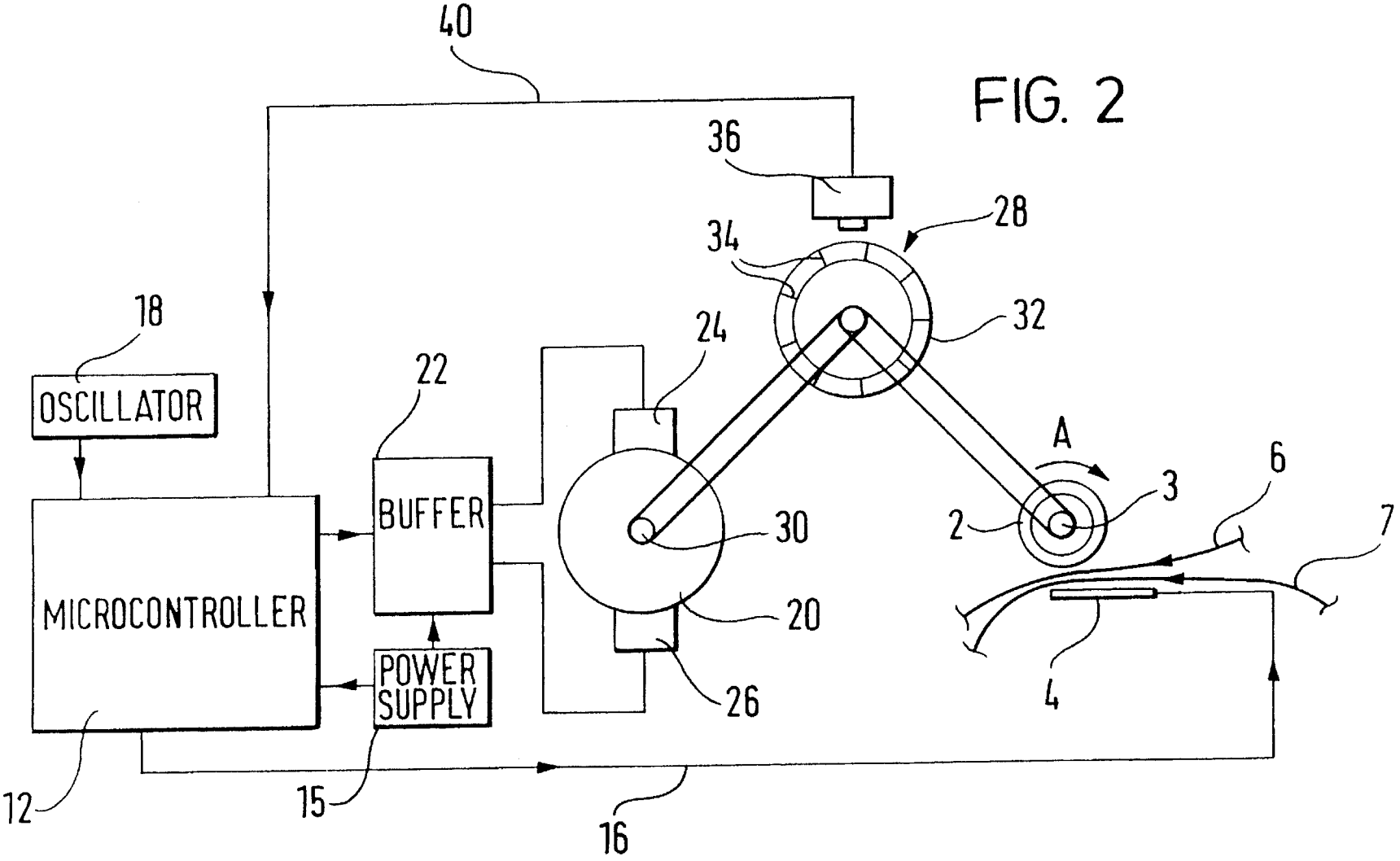
FIG. 2 is a diagram showing the elements of a drive system according to one embodiment of the present invention.

For a better understanding of the present invention, and to show how the same may be carried into effect, reference will now be made by way of example to FIGS. 2 and 3 of the accompanying drawings. It will readily be appreciated that the drive system described herein is particularly suitable for use in label printing apparatus of the type described earlier.

Figure 1:
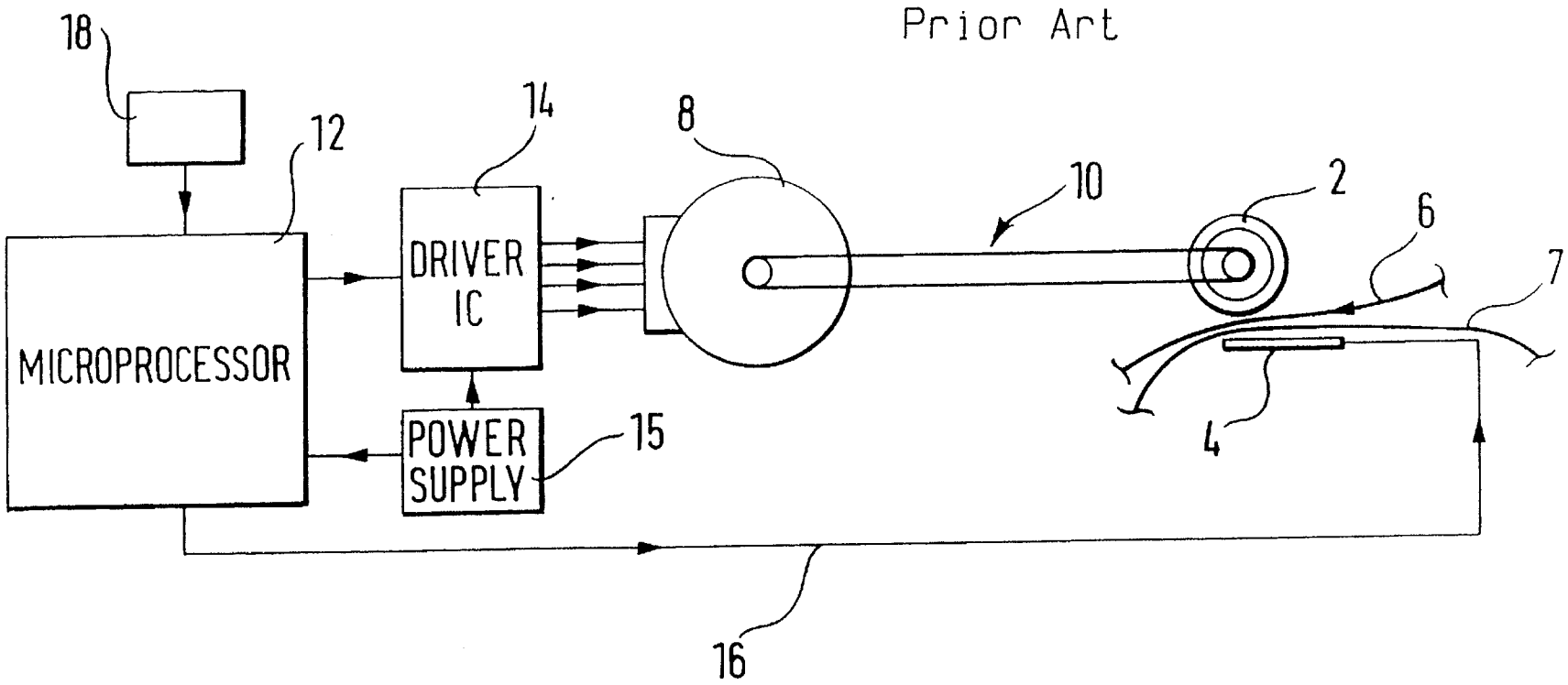
FIG. 1 Prior Art
FIG. 1 is a diagram showing the elements of a drive system according to a known printer.
Figure 4:
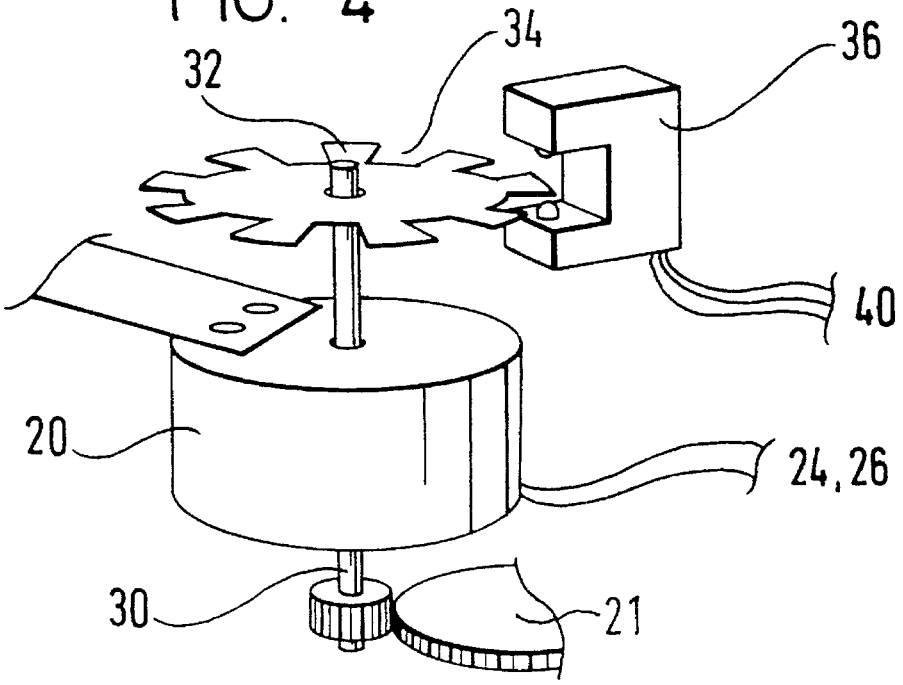
FIG. 4 is a diagram of the main elements of the shaft encoder.

In common with FIG. 1, reference numeral 2 denotes a rubber platen mounted for rotation about an axis 3 extending through the plane of the paper and indicated by reference numeral 3. The platen rotates in the direction of arrow A. Reference numeral 4 denotes the thermal printhead and reference numerals 6 and 7 denote the tape and ink ribbon passed in overlap between the platen 2 and the printhead 4. The drive system differs from that discussed above in relation to FIG. 1 in that the stepper motor is replaced by a dc motor 20. This is driven from the microcontroller 12 via a current buffer 22 using pulse width modulation to approximate a linear control voltage for the dc motor 20 at its terminals 24,26. As is well known, a dc motor rotates continuously at a speed related to the applied voltage. The rotation is continuous and not step-wise, A shaft encoder which is indicated diagrammatically by reference numeral 28 is connected to the motor shaft 30 for monitoring the,speed of the motor. The shaft encoder comprises a slotted disc 32, for example with nine slots 34, attached to the motor shaft, with a fixed optical sensor 36 comprising an infrared light emitting diode (LED) and phototransistor which senses the passage of radiation from the LED to the phototransistor through the slots 34 of the slotted disc 32. The optical sensor 36 supplies pulses to the microcontroller 12 via a feedback line 40, each pulse indicating the passage of one slot 34 of the slotted disc 32 past the optical sensor 36. Thus, the microcontroller 12 Can determine the speed of the motor 20 by measuring the frequency of the pulses fed back to it along line 40 from the optical sensor 36. The elements of 6he shaft encoder are shown in more detail in FIG. 4, where reference numeral 21 denotes a gear train for driving the platen from the motor.

As in FIG. 1, a crystal oscillator 18 provides reference clock cycles for the microcontroller 12. Also, the microcontroller 12 supplies print data along line 16 to the thermal printhead 4 which has a storage register and a shift register as discussed above in relation to FIG. 1. That is, on each print strobe signal, the column of data held in the storage register is printed. In FIG. 2, reference numeral 15 denotes a power supply for the current buffer 22 and the microcontroller 12. The power supply can be mains or batteries.

The speed of the dc motor 20 is controlled by the microcontroller using a simple algorithm which measures the number of reference clock cycles from the crystal oscillator 18 between successive encoder pulses which are supplied to the microcontroller along feedback line 40. The value obtained from this measurement is used to calculate the speed of the motor and this in turn is used to alter the pulse width of the pulse width modulated drive signal to the current buffer 22 to adjust the motor drive in a manner as to hold the speed constant. If the speed of the motor falls below a certain value, maximum drive is applied to the motor. If the speed exceeds another, higher value, no drive is supplied to the motor. In between these maximum and minimum values, a linear speed versus drive characteristic is applied. This results in a simple, if rather coarse, speed control of the motor. Clearly, as the microcontroller has knowledge of the approximate motor speed at all times, it can take appropriate action if the speed is outside certain limits.

The fact that there is only a somewhat coarse control of the speed of the dc motor is not a disadvantage in the present invention for the reason that print strobe signal which control the printing of each column of data and the supply of the next column of data to the printhead is made responsive to the encoder pulses which are fed back to the microcontroller along line 40. For example, a data strobe signal can be produced for exactly one pulse, for every two encoder pulses or for any integral number of pulses. On each data strobe signal, a column of data stored in the storage register of the thermal printhead is printed. At the next strobe signal, the next column of data which has been transferred to the storage register from the shift register is printed. In this way, the deposition of ink on the printing tape is related exactly to the rotation of the motor and thus to the motion of the tape. This contrasts with the known system, where the control of the motor and the control of the printhead are carried out independently in response to the same reference clock. With the present invention, significant speed variations have a negligible effect on print quality, as the print strobe signals supplied to the printhead slow down or speed up in response to the actual speed of the motor, and thus the speed of the tape.

This has the benefit that it is not necessary to design a complicated and potentially costly controller for accurate speed control. The system can therefore be implemented in a low cost general purpose microcontroller with little overhead to distract it from other tasks, such as handling the print data itself.

The system has several advantages compared with a conventional system using a stepper motor:

1. It permits a lower cost product design of similar performance. The cost of components for the dc motor, encoder, optical sensor, current buffer and any extra gear train components which might be required is less than half that of the stepper motor and its driver chip.
2. Under normal conditions, the above mentioned technique gives a print quality equivalent to that obtained using a stepper motor but using a dc motor because of the compensation for speed variations. It will readily be appreciated from the above that any alternative continuous rotation system using a speed controlled dc motor but which does not use feedback to adjust strobe timings for the strobing signals to the printhead will have inferior print quality because the system would be subject to speed variations as friction varies, with no compensation for this effect. Moreover, the above described system is relatively cheap because the speed control is performed by the microcontroller which also performs many other tasks in the printing apparatus and is thus an essential component of the printing apparatus irrespective of its speed control application.
3. It runs at lower power than conventional stepper motor systems, reducing a drain on batteries, since dc motors are more efficient than stepper motors in constant speed applications. This is of paramount importance in small hand held labelling machines.
4. The inventors have discovered that the use of a dc motor as described above is preferable to a stepper motor. This is because the stepper motor moves in discrete steps and stops between each one. Backlash and deformation in the gear train and rubber platen roller can give rise to unstable motion. As a result it is more difficult to manufacture machines with a consistent print quality when Using a stepper motor.

By using a dc motor with print timing determined by an encoder pulse, as described above, it is possible to achieve the following in additional to the cost and power reduction listed above:

a low cost control implementation which allows the speed to vary with the load but still maintains accurate dot positioning; and improvement to production quality levels because the tape is continuously moving and thus backlash and elasticity in the transmission do not affect print quality.

It also provides a situation where the control algorithm in the microprocessor, which allows speed to change with the friction load, can be extended to detect end of tape by one of three techniques:

(1) detecting a complete stop;

(2) detecting an increase in friction if tape is secured by an adhesive onto a tape supply reel;

(3) detecting a decrease in friction as the end of the tape exits the machine if it was not bonded to a supply reel.

The detection of end of tape is discussed more fully in the following which discusses another aspect of the present invention.

Another aspect of the invention will now be discussed with reference to FIGS. 2 and 3. The pulses fed back along line 40 can give an indication of a motor stall condition (that is, no rotation even with an applied voltage) or a partial stall, which could be due to faults such as a jammed tape or a mechanism failure, or due to the end of the tape being reached. Thus, the system can be used to provide an end-of-tape indication in a system where the printing tape is secured to its bobbin and is optionally provided with high friction material at its end so that the end of the tape is manifested by a motor stall or partial stall. This will be detected by the shaft encoder and could thus be indicated by the microcontroller.

Figure 3:
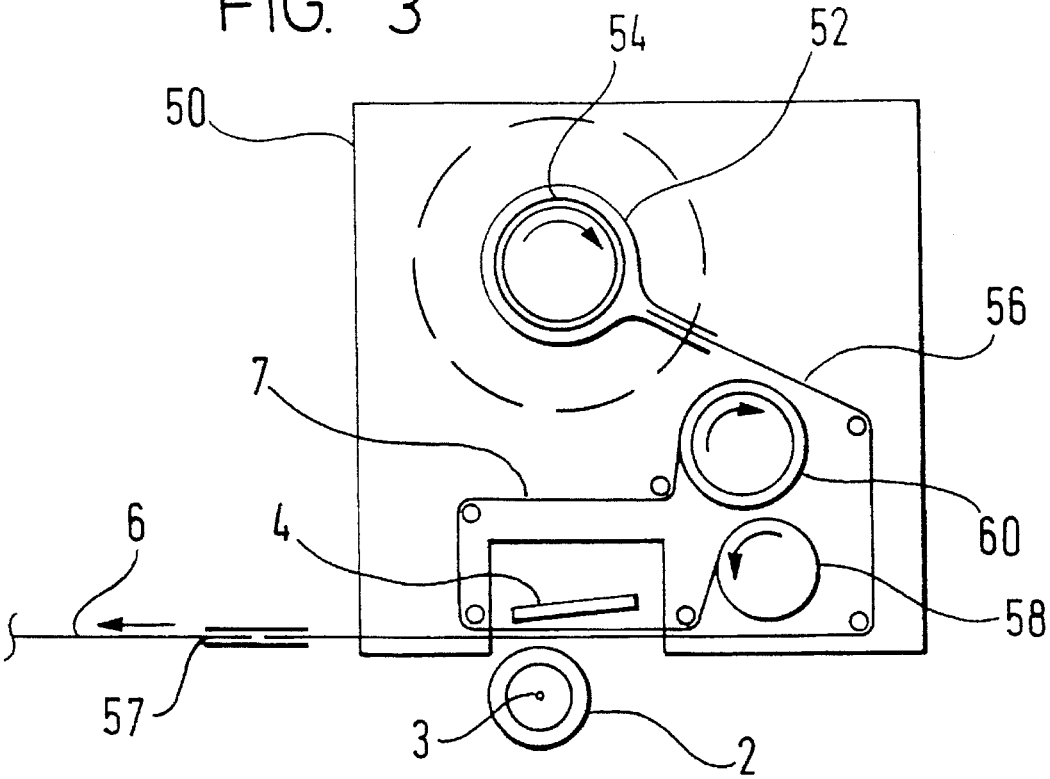
FIG. 3 is a diagram illustrating a cassette for use with the invention to denote an end of tape condition.

FIG. 3 is a sketch of a cassette which can be used in such an end-of-tape indication system. In FIG. 3, reference numeral 50 denotes a cassette housing. Self-adhesive tape 52 extends around a printing tape bobbin 54 which rotates in the direction indicated by the arrow and is used to secure high friction material 56 to the bobbin. The cassette is shown with the tape having reached its end, the high friction material extending from the bobbin to the end of the printing tape denoted at 57 and to which it is secured by splicing. The ink ribbon 7 extends from a supply reel 58 to a take-up reel 60 which is driven in the direction of the arrow. The printing tape 6 passes in overlap with the ink ribbon 7 between the thermal printhead 4 and the platen 2 at the print zone. The platen 2 is driven in the direction of the arrow by the dc motor 20 as discussed earlier.

The cassette operates in a printing apparatus as described above. That is, the dc motor 20 drives the platen 2 for rotation with its speed being controlled as a result of feedback from the shaft encoder. When the end of the tape is approached, the high friction material 56 is in contact with the platen and thus causes the motor to slow down and, finally, to shall because the end of the tape is secured to its bobbin and therefore cannot move. This is denoted by the microcontroller as an end-of-tape condition. The principle is thus that tape motion must cease at the end of the tape, and the tape should slow down the platen or bring it to a stop due to the action of friction between the high friction material and the platen, thus stalling the motor. The high friction material 56 provided at the end of the tape will help to ensure this, but it may not always be necessary. In that case, the end of the printing tape itself will slow the platen. Nevertheless, the motor controller will apply maximum drive voltage in this condition so the friction level to stall the motor does need to be high.

While a particular embodiment of a thermal printhead has been described it will be appreciated that the printhead could be controlled differently by the microcontroller and need not necessarily include shift registers and storage registers. Instead the data could be passed for example directly to the thermal printhead printing elements from the microcontroller.

What is claimed is:

1. A label printing apparatus comprising:

a housing having a cassette receiving bay for receiving a cassette holding printing tape on which an image is printed;

a printing mechanism including a thermal printhead having a group of printing elements to which pixel date defining the image to be printed is passed sequentially on a group-by-group basis by a printhead controller connected to data input device; and a drive system operatively connected to said printing mechanism comprising:

a motor operable to continuously drive said printing tape past the printing mechanism in a printing direction and having a speed of rotation at an approximately constant level;

means for monitoring the speed of rotation of the motor and connected to said printhead controller to cause said groups of pixel data to be sequentially printed adjacent one another in the printing direction of the printing tape in dependence on the speed of rotation of the motor; and means for controlling the speed of rotation of the motor to maintain the approximately constant level by applying a maximum drive to the motor if the speed detected by the monitoring means falls below a first predetermined value, no drive if the speed exceeds a second predetermined value and a linear drive versus speed characteristic between the first and second pretermined values.

2. A printing apparatus according to claim 1 wherein the printing mechanism includes a platen which is caused to rotate by the drive motor and which moves the printing tape through friction.

3. A printing apparatus according to claim 1 wherein the speed monitoring means comprises a shaft encoder.

4. A printing apparatus according to claim 3 wherein the shaft encoder comprises a slotted disc arranged to rotate with a shaft of the dc motor and a light source and a light detector on opposed sides of the disc.

5. A printing apparatus according to claim 3 wherein the shaft encoder generates pulses at a frequency dependent on the speed of rotation of the motor and wherein said pulses cause the print head controller to generate data strobe signals each of which causes a group of pixel data to be printed.

6. A printing apparatus according to claim 5 wherein a data strobe signal is produced for an integral number of pulses generated by the shaft encoder.

7. The label printing apparatus of claim 1 wherein the motor is a dc motor.

8. The label printing apparatus of claim 1 wherein the housing carries the data input device for inputting information defining the image to be printed.

9. A method of operating a label printing apparatus which comprises a housing housing a cassette receiving base for receiving a cassette holding printing tape on which an image is printed, the method comprising the steps of:

inputting information at a data input device defining the image to be printed;

driving a motor to continuously rotate to drive the printing tape past a printing mechanism which includes a thermal printhead having a group of printing elements to which pixel data defining the image to be printed is passed sequentially on a group by group basis by a printhead controller;

monitoring the speed of rotation of the motor;

controlling the speed of rotation of the motor to maintain the approximately constant level by applying a maximum drive to the motor if the speed detected by the monitoring means falls below a first predetermined value, no drive if the speed exceeds a second predetermined value and a linear drive versus speed characteristic between the first and second pretermined values; and controlling the sequential printing of groups of pixel data in dependence on the speed of rotation of the motor so that said groups are printed adjacent one another in a direction of movement of the printing tape.

10. A method according to claim 9 wherein the step of driving the dc motor causes a platen which cooperates with the thermal printhead for printing said image to rotate, thereby driving the printing tape past the thermal printhead.

11. A method according to claim 9 wherein the step of monitoring the speed of rotation is used to provide an end of tape indication.

12. The method of claim 9 which further comprises the step of selecting the motor to be a dc motor.

13. The method of claim 9 which further comprises the step of configuring the housing to carry the data input device for inputting information defining the image to be printed.

* * * * *